United States Patent [19]

Ito et al.

[11] 4,193,076

[45] Mar. 11, 1980

[54] COUPLING AN OUTER ANTENNA WITH A RADIO RECEIVER HAVING A BAR ANTENNA

[75] Inventors: Ryosuke Ito; Susumu Takahashi, both of Tokyo, Japan

[73] Assignee: Sansui Electric Co. Ltd., Tokyo, Japan

[21] Appl. No.: 899,224

[22] Filed: Apr. 24, 1978

[30] Foreign Application Priority Data

Apr. 26, 1977 [JP] Japan ..... 52-48070

[51] Int. Cl.[2] ..... H01Q 1/24; H01Q 7/08

[52] U.S. Cl. ..... 343/702; 343/728; 343/788

[58] Field of Search ..... 325/365, 366, 367, 368, 325/369, 370; 343/702, 788, 728, 854

[56] References Cited

U.S. PATENT DOCUMENTS

| | | | |
|---|---|---|---|
| 3,364,492 | 1/1968 | Griffee | 343/876 |
| 3,518,681 | 6/1970 | Kiepe | 343/720 |
| 3,680,128 | 7/1972 | Wille et al. | 343/702 |

FOREIGN PATENT DOCUMENTS

| | | | |
|---|---|---|---|
| 515657 | 12/1952 | Belgium | 343/787 |
| 1021438 | 12/1957 | Fed. Rep. of Germany | 325/370 |
| 720721 | 12/1954 | United Kingdom | 343/788 |
| 748001 | 4/1958 | United Kingdom | 343/788 |

OTHER PUBLICATIONS

Hoffer, RCA TN No. 228, 1/5/59, pp. 343-702.

*Primary Examiner*—Eli Lieberman
*Attorney, Agent, or Firm*—Harris, Kern, Wallen & Tinsley

[57] ABSTRACT

Coupling an outer antenna with a radio receiver having a bar antenna is achieved by connecting the outer antenna to a coupling coil which is able to be removably mounted on a bar core of the bar antenna and by mounting the coupling coil on the bar core with such an orientation of the coupling coil that the signal received at the outer antenna does not cancel the signal received at the bar antenna. The connection between the outer antenna and the coupling coil may be made by the use of a coaxial cable with the outer conductor of the cable being not grounded to function as a ground plane. A series circuit of a switch and a resistor may be connected in parallel with the coupling coil to selectively reduce the quality factor Q of the bar antenna.

9 Claims, 9 Drawing Figures

COUPLING AN OUTER ANTENNA WITH A RADIO RECEIVER HAVING A BAR ANTENNA

BACKGROUND OF THE INVENTION

This invention relates to coupling between an outer antenna and a radio receiver having a bar antenna, and, in particular, to a method and devices for coupling an optionally used outer antenna with the receiver.

A bar antenna which comprises a magnetic bar core and a loop antenna coil wound on the bar core has been advantageously used in radio receiver, because it is small in the volume and is able to be assembled into or onto receiver cabinets.

But, in the reception in buildings, the good reception of broadcasts is not enjoyed, because the field intensity of broadcast waves is low and because the receiver is subjected to various noise.

To improve the reception in buildings, the bar antenna 1 has been provided with a link coil 3 wound on the bar core thereof, in addition to the loop antenna coil 2, to enable the use of an outer antenna, for example, a rod or whip antenna 4 by connecting the outer antenna to the link coil, as shown in FIG. 1.

But there are some disadvantages in the use of the rod antenna by connecting the rod antenna to the link coil.

A disadvantage is that the receiving sensibility lowers when a signal received at the bar antenna is in antiphase with another signal received at the rod antenna.

Since the bar antenna is a loop antenna, the directivity of the bar antenna is as shown in FIG. *2a*. On the other hand, the rod antenna is non-directional as shown in FIG. *2b*. Accordingly, the resultant directivity is a cardioid characteristic as shown in FIG. *2c*. Therefore, it will be noted that the intensity of the resultant wave signal in the use of the rod antenna and the bar antenna is rather lower than the use of the bar antenna alone, depending on the orientation of the bar antenna. It is, of course, achieved by changing the orientation of the radio receiver to obtain a greater resultant receiving power. But the change of the receiver orientation is inconvenient in actual use.

Another disadvantage is that the signal to noise ratio (S/N) lowers in a certain case.

In radio receivers using a commercial AC power, AC power lines are grounded through capacitors 5 and 5' as shown in FIG. 1, to remove noise which enters through the AC power lines. Sometimes, stray capacities between windings and core of a power transformer are employed in place of the capacitors. While, the link coil 3 is grounded at one terminal thereof. Accordingly, the noise which was removed through capacitors 5 and 5', is transmitted to the rod antenna 4 through the earth line and the link coil 3, and presents together with a signal received at the rod antenna 4 in a tuning circuit comprising the antenna coil 2 and a variable condenser.

Another disadvantage is that the rod antenna is not so effectively used.

Assuming that the signal to noise ratio (S/N) at the bar antenna is $1/0.1=10$ (20 dB), and that the S/N at the rod antenna is $1/0.01=100$ (40 dB), the S/N of the resultant signal is $(1+1)/(0.1+0.01)\approx 2/0.1=20$ (26 dB). This teaches that the use of the rod antenna in addition to the bar antenna improves the S/N only by 6 dB. The resultant S/N is far lower than that of the rod antenna alone.

It is another disadvantage that the additional rod antenna is used in a state impedance-mismatched with the link coil, because the link coil is fixedly mounted on the bar antenna, if the additional rod antenna is not correctly selected.

SUMMARY OF THE INVENTION

A general object of this invention is to provide a method and a device for coupling an outer antenna with a radio receiver having a bar antenna, with an impedance-matching with the outer antenna.

Another object of this invention is to provide a method and a device for coupling an outer antenna with a radio receiver having a bar antenna, wherein a sufficient resultant received signal is readily obtained.

A still another object of this invention is to provide a method and a device for coupling an outer antenna with a radio receiver having a bar antenna without any increase of input noise.

A yet another object of this invention is to provide a method and a device for coupling an outer antenna with a radio receiver having a bar antenna wherein the receiving operation of the bar antenna is suppressed to increase the S/N of the resultant receiving signal.

A feature of this invention is to prepare a coupling device comprising a coupling coil means which is able to be removably mounted onto a bar core of the bar antenna assembled in the radio receiver and which is impedance-matched with a used outer antenna. The coupling coil means is connected to the outer antenna and is mounted on the bar core to electromagnetically couple the coupling coil means with a loop antenna coil of the bar antenna. The mounting orientation of the coupling means is so selected that the signal received at the bar antenna is not cancelled by the signal from the outer antenna through the electromagnetic couple between the coupling coil means and the loop antenna coil.

A change-over switch means may be used for changing over a terminal of the coupling coil means to the other terminal to be connected to the outer antenna. The mounting orientation of the coupling coil means may be effectively selected by operation of the change-over switch means without actual change of the mounting orientation of the coupling coil means.

A coaxial cable may be advantageously used to connect the coupling coil means and the outer antenna, with an inner conductor thereof connecting between the outer antenna and a terminal of the coupling coil means and with an outer conductor being connected to the other terminal of the coupling coil means. The outer conductor is effectively used as a ground plane, and, therefore, the outer conductor and the coupling coil means are not grounded. Thus, the noise which is bypassed from AC power lines to ground through capacitors does not again enter through the coupling coil means.

A series circuit of a resistor and a switch may be provided in parallel with the coupling coil means. When the switch is turned on, the quality factor Q of the bar antenna is lowered so that the receiving function of the bar antenna is suppressed. Thus, the reception of the receiver is performed only by the outer antenna so that the S/N is remarkably improved.

The coupling coil means may be wound on an electroconductive bobbin having an inner diameter slightly larger than the diameter of the bar core of the bar antenna and being provided with a longitudinal slit to form a circumferential non-continuous cylindrical body. The coil means wound on the bobbin is contained in a dielectric housing having opposite end apertures, to which opposite ends of the bobbin are registered. The housing is provided with a manually operated screw which extends through a wall of the housing and the bobbin. Therefore, the coupling coil means is fixedly mounted on the bar core of the bar antenna by inserting the bar core into the bobbin through one of apertures of the housing and manually operating the screw. The switch and resistor for reducing the quality factor Q of the bar antenna may be contained in the housing.

Further objects, features and aspects of this invention will be understood from the following description relating to preferred embodiments of this invention referring to the annexed drawings.

DETAILED DESCRIPTION OF THE PREFERRED EMBODIMENTS

Briefly stated, this invention attempts to prepare a coupling coil which is able to be removably mounted on a bar antenna in radio receivers and to use the coil for coupling an outer antenna with the radio receivers.

Figure 1:
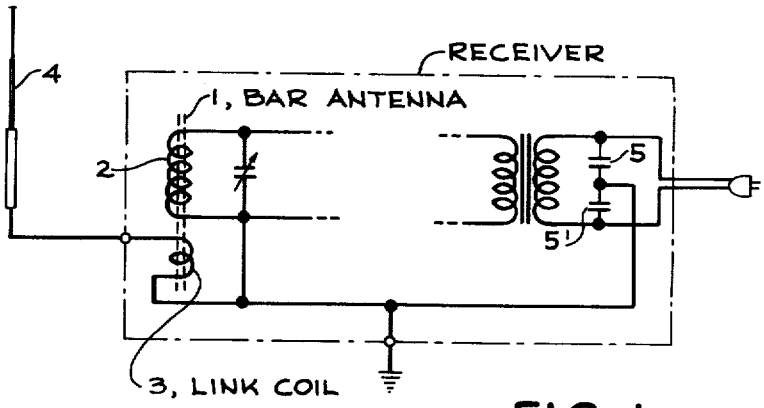
FIG. 1. PRIOR ART
FIG. 1 schematically shows a circuit diagram illustrating a known coupling between an outer rod antenna and a radio receiver having a bar antenna.
Figure 2A:
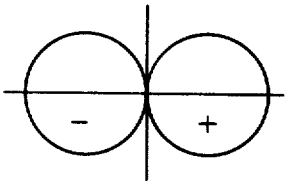
FIG. 2*a* shows a directivity of a bar antenna.
Figure 2B:
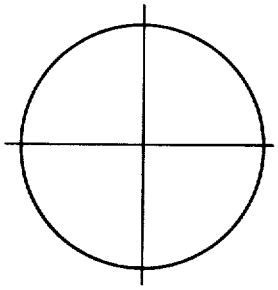
FIG. 2*b* shows a directivity of a rod antenna.
Figure 2C:
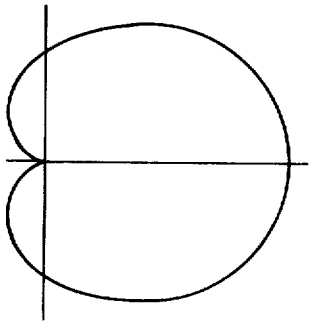
FIG. 2*c* shows a resultant directivity of a bar antenna and a rod antenna, FIG. 3 schematically shows a circuit diagram illustrating an embodiment of this invention.
Figure 3:
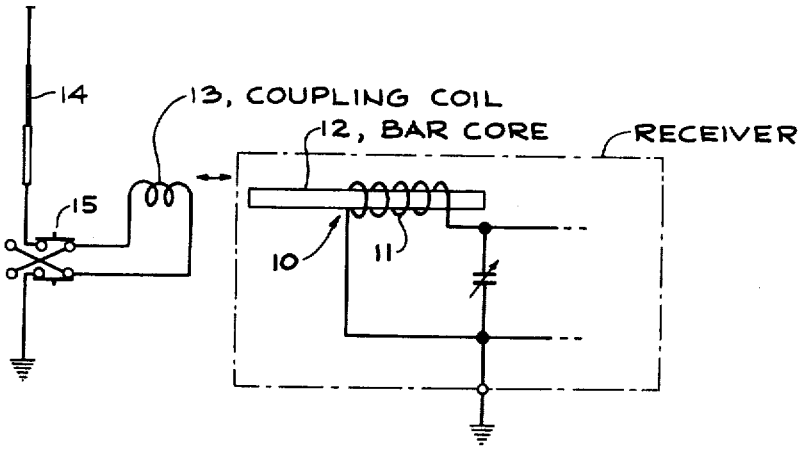

Referring to FIG. 3, a coupling coil 13 is previously formed to be able to be removably mounted on a bar core 12 of the bar antenna 10. The loop antenna coil 11 of the bar antenna is connected to a variable condenser to form a tuning circuit in the receiver as well known in the art.

One terminal of the coupling coil 13 is connected to an additional outer antenna 14, such as a rod antenna, and the other terminal of the coupling coil 13 is grounded. The coupling coil 13 is mounted on the bar core 12 by inserting the bar core 12 in a hollow portion of the coupling coil 13. Thus, the coupling coil 13 is electromagnetically coupled with the loop antenna coil 11, so that the rod antenna 14 is coupled with the tuning circuit of the radio receiver.

Since the coupling coil 13 is removably mounted on the bar core 12, the mounting orientation of the coupling coil 13 is readily changed. Therefore, it can be achieved to add the signal received at the rod antenna 14 to the signal received at the bar antenna 10 without cancellation therebetween, by controlling the orientation of the coupling coil 13 and without changing the orientation of the radio receiver.

A change-over switch 15 may be provided between the coupling coil 13 and the rod antenna 14 and ground as shown in FIG. 3. In this arrangement, once the coupling coil 13 is mounted on the bar core 12, the orientation of the coupling coil 13 can be effectively changed by the operation of the change-over switch 15 without actual change of the orientation of the coupling coil 13.

Figure 4A:
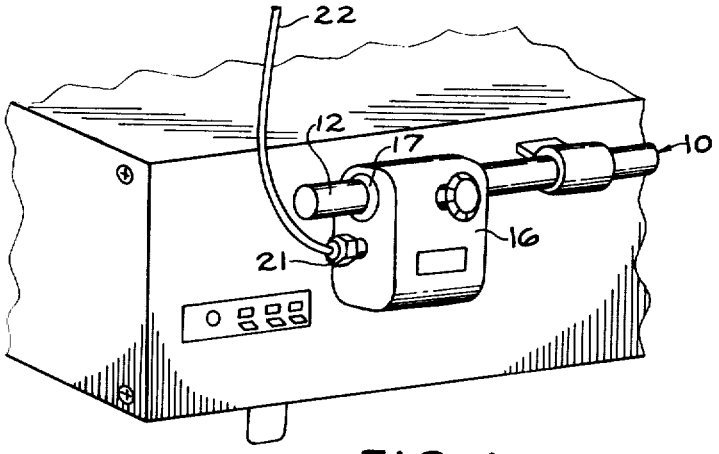
FIG. 4*a* shows a perspective view of a coupling device according to this invention, which is mounted on a bar core of a bar antenna assembled in a radio receiver.
Figure 4B:
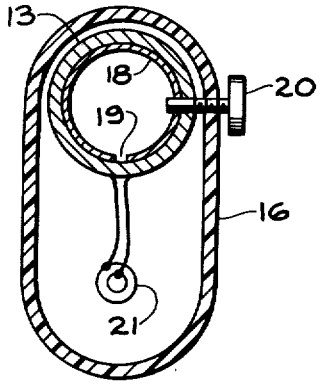
FIG. 4*b* shows a sectional view of the coupling device in FIG. 4*a*, FIG. 5 schematically shows a circuit diagram illustrating another embodiment, and FIG. 6 schematically shows a circuit diagram illustrating a further embodiment.

Referring to FIGS. 4*a* and 4*b*, a coupling device is shown, which comprises the coupling coil 13 contained within a dielectric housing 16.

The housing 16 is provided with two apertures 17 in opposite end surfaces thereof having a slightly larger diameter than the outer diameter of the bar core of the bar antenna 10.

The coupling coil 13 is wound on an electroconductive bobbin 18. The bobbin 18 is provided with a longitudinal slit 19 to form a circumferentially non-continuous cylindrical body. The bobbin 18 is fixedly mounted within the housing 16 by suitable securing means such as bolt means (not shown) in such fashion that opposite ends thereof are registered to the apertures of the housing 16, respectively.

The housing is also provided with an electric connector 21 for connecting a feeder line 22 to the coupling coil 13. The connector 21 is connected to the coupling coil 13 within the housing 16.

Accordingly, after the feeder line 22 which is connected with the rod antenna is connected to the connector 21, and, then, the housing 16 is mounted on the bar core 12 with selecting the mounting orientation, the housing 16 or the coupling device is secured on the bar core 12 by the operation of the screw. As a result, the outer antenna is coupled with the radio receiver.

If the change-over switch (15 in FIG. 3) is employed, the switch may be assembled in the housing 16.

Figure 5:
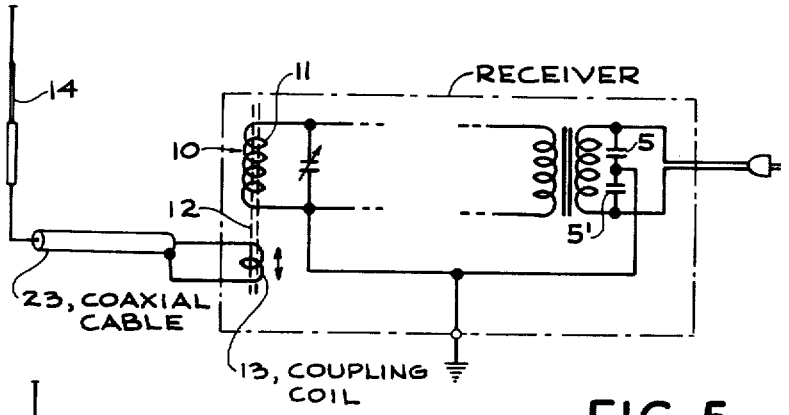

Referring to FIG. 5, a coaxial cable 23 is used as a feeder line connecting between the rod antenna 14 and the coupling coil 13 in another embodiment of this invention. The inner conductor of the coaxial cable connects between the rod antenna 14 and a terminal of the coupling coil 13. While, the outer conductor of the coaxial cable is connected to the other terminal of the coupling coil 13 but is not grounded to function as a ground plane or a radial. Namely, the signal received at the rod antenna 14 flows through the inner conductor of the coaxial cable 23 and the coupling coil 13 to the outer conductor of the coaxial cable 23, and is radiated to the space. Therefore, the signal received at the rod antenna 14 is coupled with the tuning circuit of the radio receiver without being grounded.

In this embodiment, since neither the outer antenna nor the coupling coil is grounded, it is prevented that the noise which was by-passed from AC power through capacitors to ground again enters into the receiver circuit through the outer antenna 14 and the coupling coil 13 which is electromagnetically coupled with the tuning circuit of the radio receiver.

Figure 6:
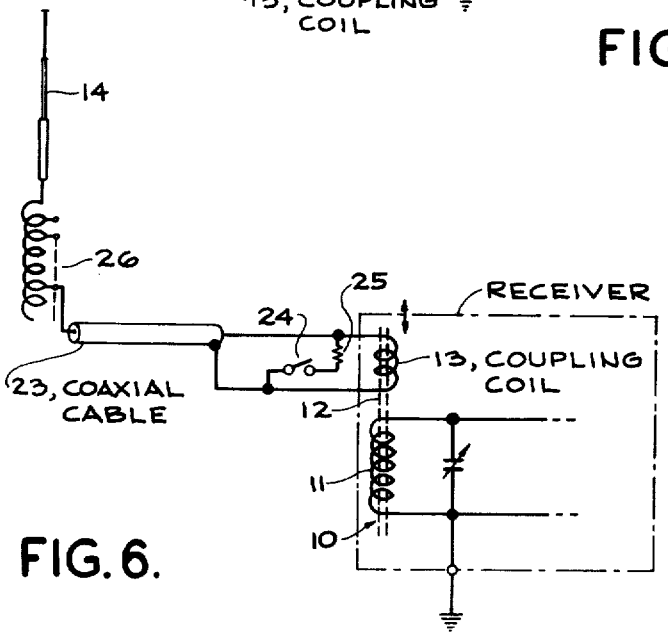

Referring to FIG. 6, the shown embodiment is characterized in that the series circuit of a switch 24 and a resistor 25 is connected to parallel with the coupling coil 13.

As well known in the art, the receiving function of the bar antenna is determined by the quality factor Q of the loop antenna coil of the bar antenna. The greater the quality factor Q is, the greater the receiving capacity is.

On the other hand, if an additional coil of one or several turns is disposed surrounding a main coil and the additional coil is short-circuited by a resistor of a low resistance of such as 1Ω, it is well known in the art that the quality factor Q of the main coil is lowered below 1/10 of the quality factor of the main coil itself.

Accordingly, when the switch 24 in this embodiment is turned on, the quality factor Q of the bar antenna is remarkably lowered, so that the reception by the bar antenna is suppressed. As a result, the reception in the radio receiver is effected by the outer antenna. Therefore, the entrance of various noises in buildings is prevented so that the reception with an excellent S/N ratio may be enjoyed.

If the switch 24 is turned on, the impedance of the coupling coil 13 is changed. Therefore, it is required that the outer antenna 14 is selected to impedance-match the resultant impedance of the resistor 25, the coupling coil 13 and the bar antenna 10.

In this embodiment, an impedance-matching coil 26 is provided between the outer antenna 14 and the coaxial cable 23. The coil 26 has a plurality of taps. Therefore, any optional outer antenna can be used in the impedance-matched state by selecting the tap being connected to the coaxial cable 23. In either state that the switch 24 is turned on or that the switch is turned off, impedance-matching is also achieved by selecting the tap being connected to the coaxial cable 23.

In this embodiment, the coupling coil is also contained in the housing similarly as described referring to FIGS. 4*a* and 4*b*. In the case, the switch 24 and the resistor 25 are also mounted in the housing.

This invention has been described in detail relating to preferred embodiments which are merely for exemplification, and to which this invention is not restricted, and various other modifications and other designations will be easily made by those skilled in the art within the scope of this invention.

What is claimed is:

1. A method for coupling an outer antenna with a radio receiver having a bar antenna, which comprises:

preparing a coupling coil means which is able to be removably mounted on a bar core of the bar antenna and which is impedance-matched with the outer antenna;

connecting said coupling coil means between the outer antenna and ground; and mounting said coupling coil means onto the bar core of the bar antenna to electromagnetically couple said coupling coil means with a loop antenna coil of the bar antenna by inserting the bar core in a hollow portion of said coupling coil means under control of axial orientation of said coupling coil means so that a signal received at the outer antenna may not cancel, but be added to a signal received at the bar antenna itself.

2. The method as claimed in claim 1, wherein the connection of two terminals of said coupling coil means with said outer antenna and the earth terminal is controlled by the use of a change-over switch means to prevent the signal received at the bar antenna itself from being cancelled by the signal received at the outer antenna which is coupled with the bar antenna by said coupling coil means.

3. A method for coupling an outer antenna with a radio receiver having a bar antenna, which comprises:

preparing a coupling coil means which is able to be removably mounted on a bar core of the bar antenna and which is impedance-matched with the outer antenna;

connecting said coupling coil means to the outer antenna by a coaxial cable, with an inner conductor thereof being connected between the outer antenna and a terminal of said coupling coil means and with an outer conductor being connected to the other terminal of said coupling coil means, the outer conductor serving as a radial; and mounting said coupling coil means onto the bar core of the bar antenna to electromagnetically couple said coupling coil means with a loop antenna coil of the bar antenna by inserting the bar core in a hollow portion of said coupling coil means under control of axial orientation of said coupling coil means so that a signal received at the outer antenna may not cancel, but be added to a signal received at the bar antenna itself.

4. The method as claimed in claim 3, wherein a resistor having a lower resistance is connected in parallel with said coupling coil means to suppress the receiving function of the loop antenna coil of the bar antenna.

5. A device for coupling an outer antenna with a radio receiver having a bar antenna, which comprises:

a feeder line connected to said outer antenna; and a coupling coil means connected with said feeder line and which is formed to be able to be removably mounted on a bar core of the bar antenna and which is impedance-matched with the outer antenna, whereby said coupling coil means may be removably mounted on the bar core by inserting the bar core into a hollow portion of said coupling coil means under control of axial orientation of said coupling coil means so that a signal received at the outer antenna may not cancel, but be added to a signal received at the bar antenna itself.

6. The device as claimed in claim 5, wherein said feeder line is a coaxial cable, with an inner conductor being connected between the outer antenna and a terminal of said coupling coil means, and with an outer conductor being connected to the other terminal of said coupling coil means, said outer conductor being non-grounded but serving as a radial.

7. The device as claimed in claim 6, which further comprises a series circuit of a switch means and a resistor having a low resistance which is connected in parallel with said coupling coil means, whereby the receiving function of said bar antenna is suppressed by turning on said switch means.

8. The device as claimed in claim 7, which further comprises an impedance-matching coil means having a plurality of taps for connecting between the outer antenna and said coaxial cable, one of opposite end terminals of said impedance-matching coil means being connected to the outer antenna, and one of said taps being selectively connected to said inner conductor of said coaxial cable to impedance-match with the outer antenna.

9. A device for coupling an outer antenna with a radio receiver having a bar antenna, which comprises:

a dielectric housing having apertures in opposite end plates thereof, each aperture having a diameter permitting a bar core of the bar antenna to be inserted thereto;

an electroconductive bobbin being provided with a longitudinal slit to form a circumferentially non-continuous cylindrical body, said bobbin being secured within said housing in such fashion that opposite ends of said bobbin are registered to said apertures of said housing;

a coupling coil mounted on said bobbin;

an electric connector for connecting a feeder line to said coupling coil, which is secured to the housing wall and is connected with said coupling coil; and a manually operated screw means for removably securing said device to the bar core which is inserted into said bobbin through said apertures of said housing, said screw means being provided to extend through the housing wall, said coupling coil and said bobbin into said bobbin.

* * * * *